US005617082A

United States Patent [19]

Denison et al.

[11] Patent Number: 5,617,082

[45] Date of Patent: Apr. 1, 1997

[54] ELECTRONIC ACCESS CONTROL DEVICE UTILIZING A SINGLE MICROCOMPUTER INTEGRATED CIRCUIT

[75] Inventors: William D. Denison, Palos Hills; Lawrence C. Brownfield, Downers Grove; Bradley S. Silvers, Oswego, all of Ill.

[73] Assignee: Micro Enhanced Technology, Inc., Palos Hills, Ill.

[21] Appl. No.: 339,555

[22] Filed: Nov. 15, 1994

[51] Int. Cl.[6] ..... E05B 49/00

[52] U.S. Cl. ..... 340/825.31; 307/10.1; 307/10.2; 307/10.5; 361/172; 361/171; 340/825.56; 340/825.69

[58] Field of Search ..... 340/825.31, 825.56, 340/825.69; 307/10.1, 10.2, 10.5; 361/172, 171

[56] References Cited

U.S. PATENT DOCUMENTS

| | | | |
|---|---|---|---|
| 4,205,325 | 5/1980 | Haygood et al. | 340/825.56 |
| 4,206,491 | 6/1980 | Ligman et al. | 361/172 |
| 4,670,747 | 6/1987 | Borras et al. | 340/825.56 |
| 4,672,375 | 6/1987 | Mochida et al. | 307/10.5 |
| 4,688,036 | 8/1987 | Hirano et al. | 307/10.5 |
| 4,703,359 | 10/1987 | Rumbolt et al. | 340/825.69 X |
| 4,746,919 | 5/1988 | Reitmeier | 340/825.56 |
| 4,760,393 | 7/1988 | Mauch | 340/825.56 |
| 4,839,639 | 6/1989 | Sato et al. | 340/825.44 |
| 4,857,914 | 8/1989 | Thrower | 340/825.56 |
| 4,942,393 | 7/1990 | Waraksa et al. | 340/825.72 |
| 5,021,776 | 6/1991 | Anderson et al. | 340/825.31 |
| 5,043,720 | 8/1991 | Laurienzo | 340/825.32 |
| 5,479,151 | 12/1995 | Lavelle et al. | 340/542 |

FOREIGN PATENT DOCUMENTS

| | | |
|---|---|---|
| 4238979 | 8/1992 | Japan . |
| 689391 | 3/1994 | Japan . |

*Primary Examiner*—Brian Zimmerman
*Assistant Examiner*—William H. Wilson, Jr.
*Attorney, Agent, or Firm*—Leydig, Voit & Mayer, Ltd.

[57] ABSTRACT

An electronic access control system for controlling a lock in which the inputs and outputs are multiplexed, the electrically programmable read only memory is written to and read from in a serial manner, and the operator can disable access codes and enable access codes in one operation. The device reduces power consumption when powering a solenoid or DC motor by pulsing the output power. Further, the device is able to be operated in a remote location whereby the remote device can accept inputs from a keypad, an electronic signal, or a telephone line. The remote device, when not in active operation, operates in a low power mode so that the remote device may be powered by a battery.

32 Claims, 7 Drawing Sheets

ELECTRONIC ACCESS CONTROL DEVICE UTILIZING A SINGLE MICROCOMPUTER INTEGRATED CIRCUIT

FIELD OF THE INVENTION

The invention relates to an electronic access control device for industrial, commercial, or residential use which can operate independently or as part of a central control system.

BACKGROUND OF THE INVENTION

An electronic access control device, or more commonly, an electronic combination lock, does not require a key to open the lock. This eliminates the problems associated with keys such as the cost of producing the keys and the cost of replacing lost keys. Electronic access control devices are known, for example, from U.S. Pat. No. 5,021,776. In this device, and other common electronic access control devices, a microprocessor is used in combination with a keypad and an electrically programmable read only memory (EPROM). The microprocessor compares the combination entered in the keypad by the operator with the combination stored in the EPROM. If the two combinations match, the microprocessor opens the lock.

Problems associated with previous electronic access control devices fall into two areas. The first area concerns the operation of the stand alone unit in terms of manufacture and use. Problems associated with manufacture include difficulty in programming the EPROM. EPROMs, which usually require parallel programming, interrupt the manufacturing process in that they restrict when the manufacturer can program the device. A manufacturer would prefer to program the access code into the EPROM as the last step in the manufacturing process. However, with parallel EPROMs, burning in the code after the device is manufactured is difficult. After the device is soldered together, the manufacturer must contend with integrated circuit pin clips and must worry about interference with other circuitry on the manufactured device. Further, manufacturing, with known electronic access control devices, requires many pin connections which increase manufacturing cost.

Problems associated with use include reliability and ease of use of the electronic access control device. Electronic access control devices, by their nature, must be extremely reliable. However, when the device contains a significant number of pin connections, the reliability of the device decreases. Further, serial access to the EPROM to determine the electronic access code is easier than parallel access in terms of pin connections. When the user forgets or loses the access code in the EPROM, a locksmith could plug into the device and retrieve the access code serially without breaking into the safe. However, with parallel EPROMs, serial access is not available. Moreover, another problem associated with use is the limited power associated with the battery. The use of a solenoid in opening the lock is power intensive. Thus, the battery is limited in its operative life.

The second area of problems associated with electronic access control devices is remote use. The problems focus on the power constraints of electronic locks. Often, one may be interested in powering remote access locks by battery if a constant power source is not available. However, batteries cannot be used since remote units consume a great deal of power in standard operation and therefore are too power intensive to be powered by batteries.

SUMMARY OF THE INVENTION

It is a general object of the invention to develop an electronic access control device which is easier to manufacture and more reliable to operate.

It is a related object of the invention to develop an electronic access control device which has fewer total components and pin connections for smaller device area and greater reliability.

It is a further related object of the invention to develop an electronic access control device which has pin connections which serve as inputs and outputs for the device.

It is still a further related object of the invention to develop an electronic access control device which is capable of serial programming and serial reading of the electronic access code.

It is still another related object of the invention to develop an electronic access control device which can reduce the power consumption in operating the solenoid.

It is yet still a further related object of the invention to develop an electronic access control device which can be operated remotely using only a battery as a source of power.

The present invention accomplishes these objectives and overcomes the drawbacks of the prior art. First, the electronic access control device reduces the number of pin connections required to manufacture, to read, to program, and to operate the device. The device multiplexes the inputs and outputs so that a single pin can function as an input in one mode and an output in another. The microprocessor determines, based on the mode of operation, whether a pin functions as an input or an output. For example, the keypad data input pins, the pins for programming and for reading the access code in the EPROM, and the device output pins, such as the acoustic output, are multiplexed so that the microprocessor has a lower number of pin connections.

This arrangement allows for easier manufacture and smaller total device area. First, the multiplexing allows for serial programming of the EPROM. Thus, the manufacturer can program the access code easily as part of the last step of manufacturing. The manufacturer needs to access less pins to program the device serially, rather than in parallel. Further, the multiplexing reduces the pin connections since the pins are used as inputs and outputs so that the manufacturer has less work in terms of assembling the device.

Further, this arrangement allows for easier use of the device. The lower number of pin connections allows for increased reliability of the device since a device may fail based on a faulty pin connection or because of a degradation of the pin connection over time. Further, the serial output of the EPROM enables the user to retrieve the access code from the EPROM more easily since there are fewer pins to access to retrieve the data.

Another problem associated with use is the power intensive needs of the solenoid. In the present invention, the electronic access control device pulses the power to the solenoid so that the overall power consumption in operating the solenoid is lower. Thus, the battery has a longer life and the lock has an increased number of accesses.

The device also is capable of being powered by a battery in remote access use. The device, during the majority of its operation, remains in a sleep mode whereby the circuit has a low operating current thereby decreasing power consumption to the remote unit and allowing the use of battery power.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
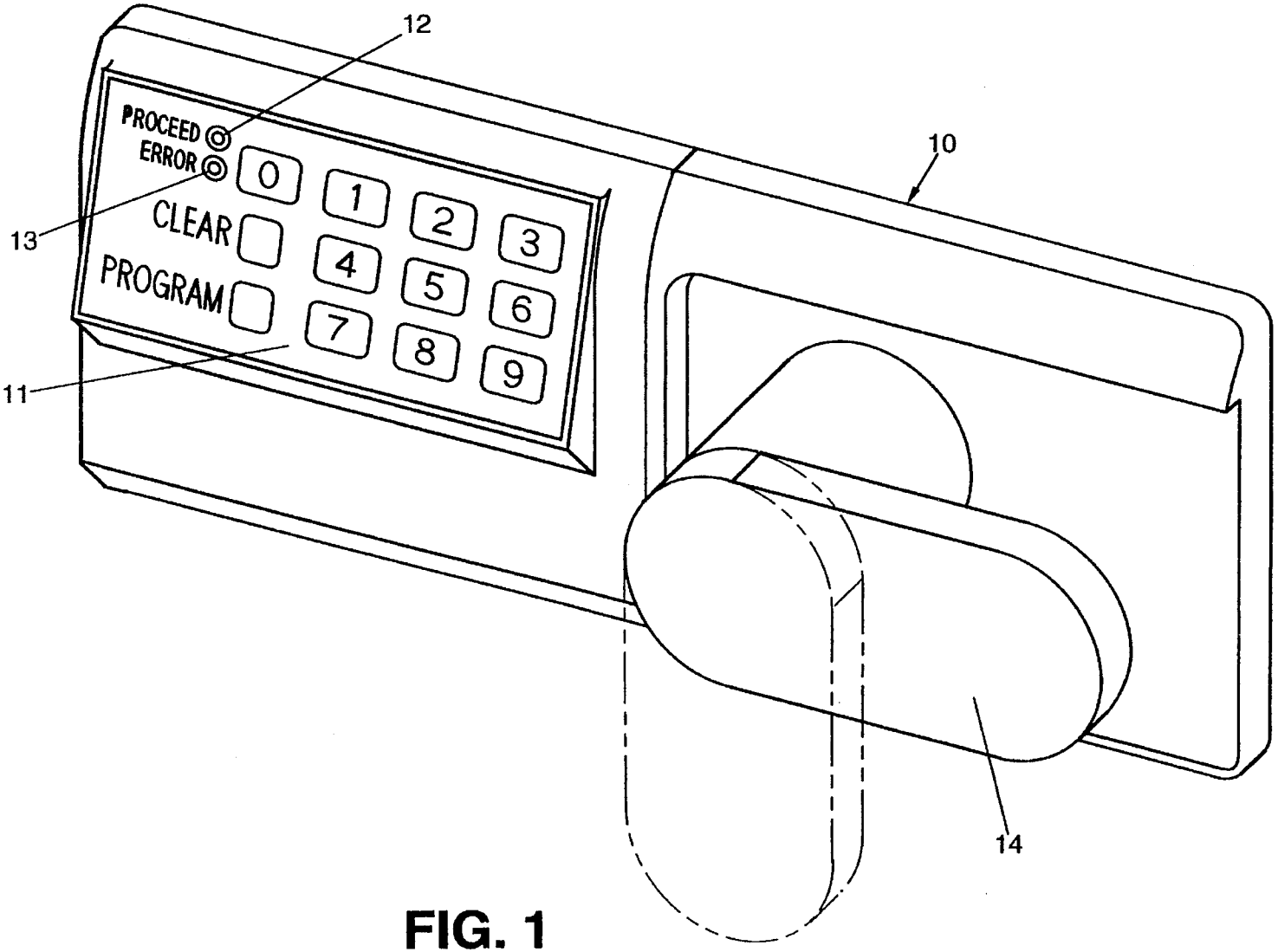
FIG. 1 is a three-dimensional representation of the electronic access code device.

Referring to the drawings, there is shown in FIG. 1 an illustrative electronic access control device 10 having a keypad 11, light emitting diodes (LEDs) 12 and 13, and a mechanical lever arm 14. In this illustration, the device is used as a lock for an office safe. The device can also be applied to various applications including locks for vending machines or amusement games.

Figure 2:
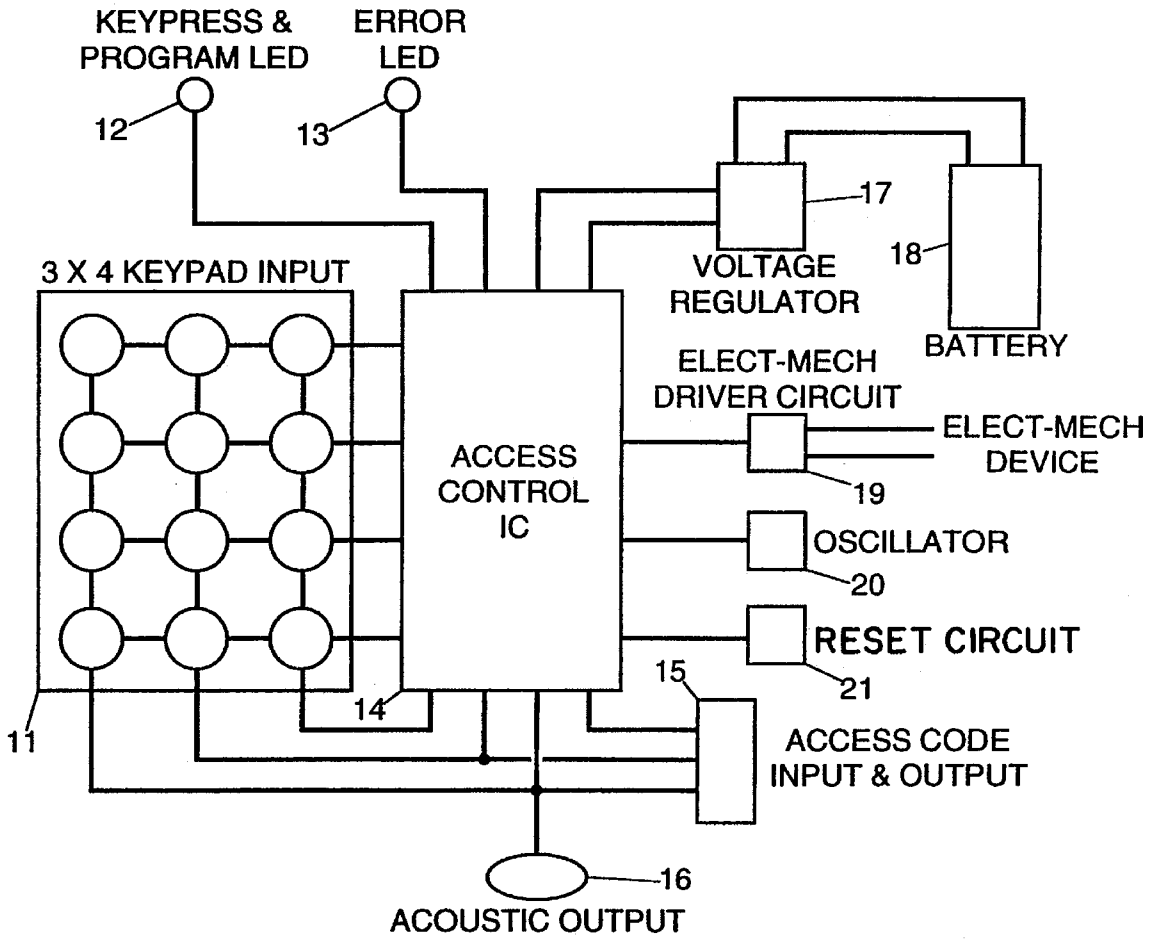
FIG. 2 is a block diagram of the device.

The main components of the electronic access code device are shown in FIG. 2 which include a keypad 11, a microprocessor 14, an access code input and output 15, an acoustic output (a piezo ceramic bender, Model No. KB11541) 16, LEDs 12 and 13, a voltage regulator (LM2936Z5.0) 17, a battery 18, an electromechanical driver output 19, an oscillator 20, and a reset circuit 21. Inputs to the device may take the form of a thumbprint scan, a retinal scan, or a magnetic strip input which may work in conjunction with a keypad or as a sole means of input. Outputs may take the form of an alpha-numeric display which may work in conjunction with an acoustic output or an LED or as a sole means of output.

The manufacturers which provide microprocessors applicable to the device include: Micro-Chip (PIC 16C54, PIC 16C57, PIC 16C71, PIC 16C76); Motorola (MC68HC705J1, MC68HC705K1, MC69HC705P6, MC68HC705P8, MC68HC705P9); National Semiconductor (COP 820C); SGS-Thomson (ST 6210); Texas Instruments (370C311); Zilog (Z84C01).

Figure 3:
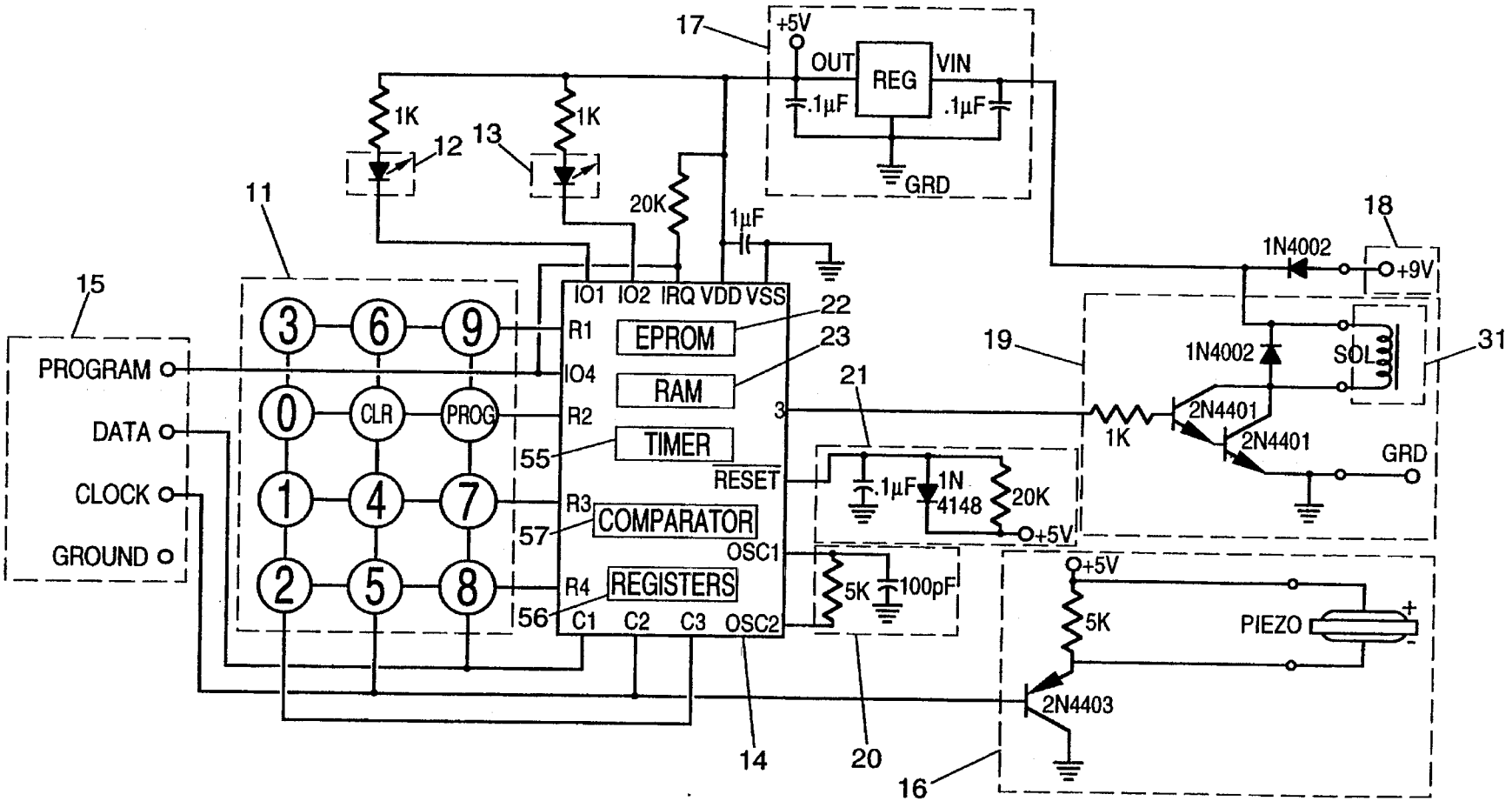
FIG. 3 is the schematic of the device.

A more detailed schematic of the device is shown in FIG. 3, highlighting the reduced pin configuration and the serial access to the electrically programmable read only memory (EPROM) 22. Several of the pins on the microprocessor 14 are multiplexed and perform multiple functions, at times used as inputs and at times used as outputs; thereby, the pin configuration is able to use only 9 pins for the keypad input, the acoustic output, and the EPROM 22 reading and writing. For example, the 12 keypad entries are shown in rows and columns. Each keypad entry in a row is connected to the corresponding pin. For example, keypads "3", "6", and "9" are connected to pin R1. Each keypad entry in the same column is connected to a corresponding pin as well. For example, keys "3", "0", "1", and "2" are all connected to pin C3.

Figure 4:
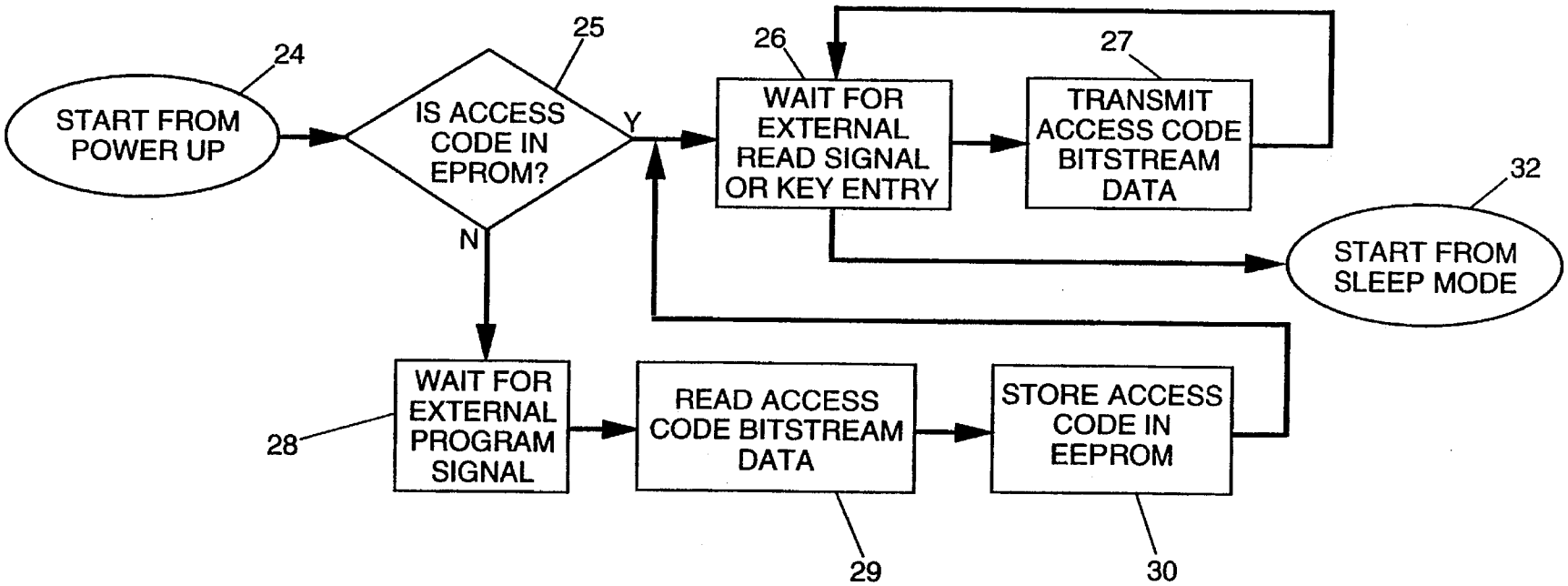
FIG. 4 is the flow chart at power-up of the device.
Figure 5:
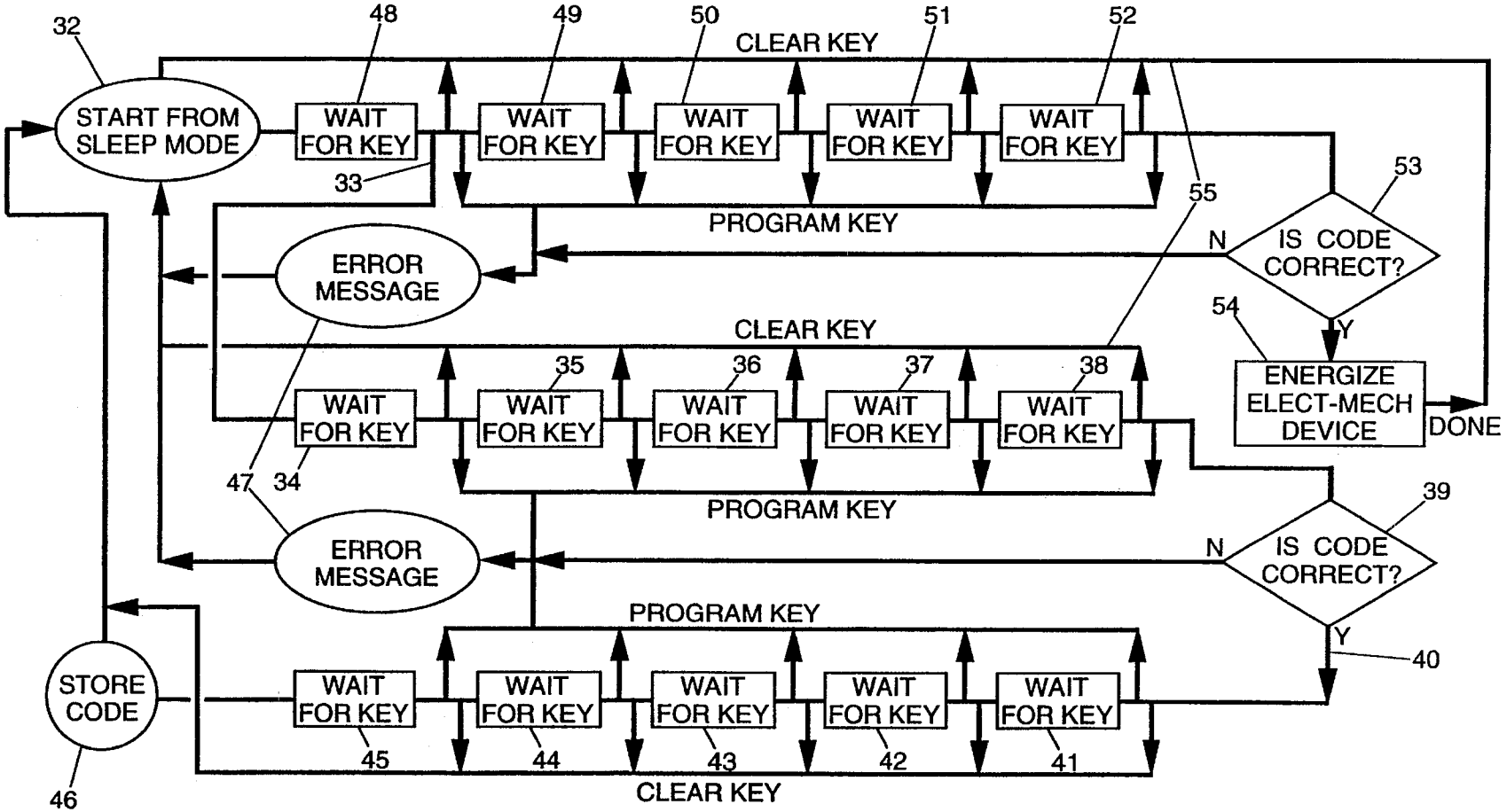
FIG. 5 is the flow chart of the device in normal operation.

The multiplexing of the keypad allows for input of twelve different inputs ("0" through "9" PROG and CLR) using a four by three configuration, as shown in FIG. 4 and FIG. 5. In particular, there are four rows and three columns in this configuration. In accordance with another embodiment, a keypad with four different inputs allows for as little as a two by two configuration through multiplexing the inputs.

The following example will illustrate the multiplexing with respect to the keypad 11. Normally, in sleep mode, pins R1, R2, R3 and R4 are waiting for an input. When, for example, the keypad "3" is input, pin R1, which keypad "3" is connected to, is triggered signifying to the microprocessor 14 that an interrupt has occurred. The microprocessor 14 then executes an interrupt in the software program and changes one of the four pins (R1, R2, R3 and R4) into an output whereby a logic high is sent to the R1 pin. When a keypad is pressed, it acts as a short circuit; thus, when the microprocessor 14 sends out a logic high, it then senses pins C1, C2 and C3 to determine exactly which keypad in the row has been pressed. In this case, where keypad "3" is input, C3 is high. Pressing keypad "3" acts as a short circuit so that when R1 is sent high, there is a direct electrical connection between pin R1 and C3 via keypad "3". Thus, the microprocessor 14 can determine that keypad "3" was pressed based on R1 and C3 both being logic high.

Another example of using multiple functions as connected to a single pin is the acoustic output 16. The acoustic output 16 is connected, via a transistor, to pin C2 Pin C2 is also connected to keypads "CLR", "4","5", and "6". When the microprocessor 14 sends an audible signal output, pin C2 acts as an output. When the microprocessor is sensing the keypad input, C2 acts as an input.

A further example of multiple functions as connected to a single pin is the EPROM 22 sensing function. The EPROM 22, as shown in FIG. 3, is part of the microprocessor 14. The DATA line (bidirectional in that the line is able to input data to write and output data to read) and CLOCK line of the EPROM 22 are connected to C1 and C2, respectively. Pins C1 and C2 are connected to the keypad as well. When the PROGRAM signal is input, C1 and C2 function as inputs when writing to the memory location in the EPROM and function as outputs when reading from the memory location in the EPROM 22. Through this arrangement, the manufacturer may serially program the device with the access code. The microprocessor 14 uses registers 56 to transmit the incoming serial data into parallel data for the EPROM 22 to input. Further, the end user may read the EPROM 22 access code serially as well. In reading the EPROM 22, only three pins must be accessed (PROGRAM, DATA, and GROUND). The microprocessor 14 uses registers 56 to transmit the outgoing parallel data from the EPROM 22 to serial form for output.

The operation of the electronic access code device is shown in flowchart form in FIG. 4 and FIG. 5. FIG. 4 shows the initialization sequence of the device upon power-up 24. The microprocessor, which contains an EPROM 22 and a random access memory (RAM) 23, checks to see if there is an access code stored 25 in the EPROM 22. The microprocessor 14 performs this operation by checking if a proprietary bit sequence is set, wherein the particular sequence of bits signifies that the EPROM 22 has a stored access code. If the bit sequence is present, the EPROM 22 contains the access code, whereby the microprocessor 14 waits for input from the keypad or waits for an external read signal 26 from the microprocessor 14.

If the bit sequence is not present, the EPROM 22 does not contain the access code in its memory. The microprocessor 14 must then wait for the external program signal 28 which signifies that the access code is being written to the EPROM 22. The external program signal, as shown in FIG. 3, is labeled PROGRAM and is connected to pin i04 and pin IRQ of the microprocessor 14. In this mode, when the PROGRAM signal is toggled, this signifies that the access code is being burned into the EPROM 22. The microprocessor 14 then uses the CLOCK and DATA lines to clock in the data thereby reading the access code. Then, the microprocessor 14 stores the access code into memory 30. The microprocessor 14 subsequently sets the proprietary bit sequence on the EPROM 22 signifying that the EPROM 22 contains the access code. Finally, the microprocessor 14 waits for input from the keypad or waits for an external read signal 26 from the microprocessor 14.

The EPROM 22 can also be used to store features other than the access code. It can be used to determine such things as: (1) the amount of time the solenoid 31 is to be energized upon opening the lock; (2) the number of key presses in the access code; (3) the option of disabling the permanent access code temporarily when a new access code is stored in RAM 23; (4) the device serial number; and (5) the date and time the device was manufactured or put in service. These features allow the manufacturer to deliver to an original equipment manufacturer (OEM) customer a generic electronic lock assembly. The OEM customer may then characterize all the specific lock features at the OEM customer facility.

As shown in FIG. 5, after the power-up initialization routine, the microprocessor waits for an entry from the keypad 32. Several functions are available based on the keypad entry. If the program key (PROG key) is first pressed, the operator wishes to input an additional access code 33. In this mode, the microprocessor 14 inputs the next five numbers from the keypad 34, 35, 36, 37, and 38. The comparator 57, within the microprocessor 14, compares the two numbers and checks if the input number matches the access code 39 from the EPROM 22 which is stored in RAM 23. If the two numbers match, this signifies that the operator knows the access code in the EPROM 22 and therefore has clearance to input an additional access code 40. Thus, the microprocessor accepts the next five numbers from the keypad as the additional access code 41, 42, 43, 44, and 45, and stores the new access code 46 in RAM 23. The operator may then input either the access code from the EPROM 22 or the additional access code to open the lock. The operator may repeat this procedure and place additional access codes into RAM 23. The additional access codes will be stored in RAM 23 until the power is removed from the microprocessor 14 at which time the RAM 23 memory will be lost.

An alternate mode of using the PROG key is to disable the permanent access code in the EPROM 22 temporarily when a new access code is entered into RAM 23. After the PROG key is hit, the microprocessor 14 inputs the next five numbers 34, 35, 36, 37 and 38. The comparator 57, within the microprocessor 14, compares the input number with the permanent access code 39 from EPROM 22. If the two numbers match, the microprocessor 14 inputs a second access code 41, 42, 43, 44, 45. In this alternative, when the microprocessor 14 stores in RAM 23 the new access code 46, it disables access to the permanent access code in RAM 23. Therefore, until the battery 18 is turned off, the only access code available is the new access code stored in RAM 23.

If an operator enters the PROG key at any time other than at the first keypad entry from sleep mode, the microprocessor will display the error message 47 by sounding the acoustic output 16 through pin C2 and the LED 13.

If a number from the keypad 11 is first entered while in sleep mode 48, the microprocessor 14 waits until another four numbers are entered 49, 50, 51, and 52, from the keypad 11. The microprocessor 14 then compares the number entered from the keypad 11 with the access code 53 stored in RAM 23. If the numbers match, the microprocessor 14 energizes the solenoid 31 at the output 54. The microprocessor 14 can also energize a DC motor, an electro-mechanical relay, or a solid-state relay. If the numbers do not match, the error message is sent 47 by sounding the acoustic output at pin C2.

If the clear key on the keypad is entered at any time in the operation of the device, the microprocessor 14 waits 5 seconds before going back into sleep mode and waiting for the next keypad entry.

One feature of the device is a lockout of keypad operations. If the microprocessor 14 receives three consecutive operations which generate error messages 47, the microprocessor 14 will disable operation of the device for two minutes. Any attempt to operate the device in the two minute lockout period will generate an error message 47.

An additional feature of the system is a requirement that a digit must be entered within a specified time. Otherwise, the microprocessor 14 will send an error message 47 if there is a five second lapse between keypad entries.

A further feature of the system is the modulated voltage across the solenoid 31. When the correct access code is input 53 from the keypad 11, the microprocessor 14 energizes the solenoid 31. The microprocessor 14 must supply sufficient power to the solenoid to unlock the lock (i.e., the solenoid must push the plunger in against the coil to open the lock). This involves two different operations. First, the solenoid 31 must physically push the plunger against the coil. Second, the solenoid 31 must keep the plunger pushed against the coil for the specified time in which to keep the lock unlocked.

The first operation (pushing the plunger) is very energy intensive. The solenoid 31 must exert kinetic and potential energy to physically move the plunger against the coil. The second operation (maintaining the position of the plunger) is less energy intensive. The solenoid 31 must exert only potential energy in terms of keeping the plunger compressed against the coil. The device, in order to unlock the lock, supplies the entire battery power necessary for the solenoid 31 to pull the plunger in against the coil. The microprocessor 14 accesses the timer 55, within the microprocessor 14, whereby the timer indicates when to reduce the power. Once the plunger is pulled in, the microprocessor 14 modulates the voltage to the solenoid 31. This reduces the current into the solenoid while the solenoid plunger is held in since the entire DC current is not required to keep the plunger in the closed position relative to the coil. This in turn reduces the total amp-hours of current out of the battery during an access cycle, and the total number of accesses to the device increases.

In the way of example, the solenoid 31 requires 300 milliamps of current to pull the plunger in. The microprocessor 14 accesses the timer 55, waiting 0.5 seconds to do that operation. The microprocessor 14 then drops the solenoid current to 150 milliamps. This current is sufficient for the solenoid 31 to keep the plunger flush against the coil. The microprocessor 14 accesses the timer 55 again, waiting for the timer 55 to indicate that three seconds have passed, supplying the lower current to allow the user to open the door. In this manner, the microprocessor 14 uses approximately ½ as much power in the modulated mode.

Figure 6:
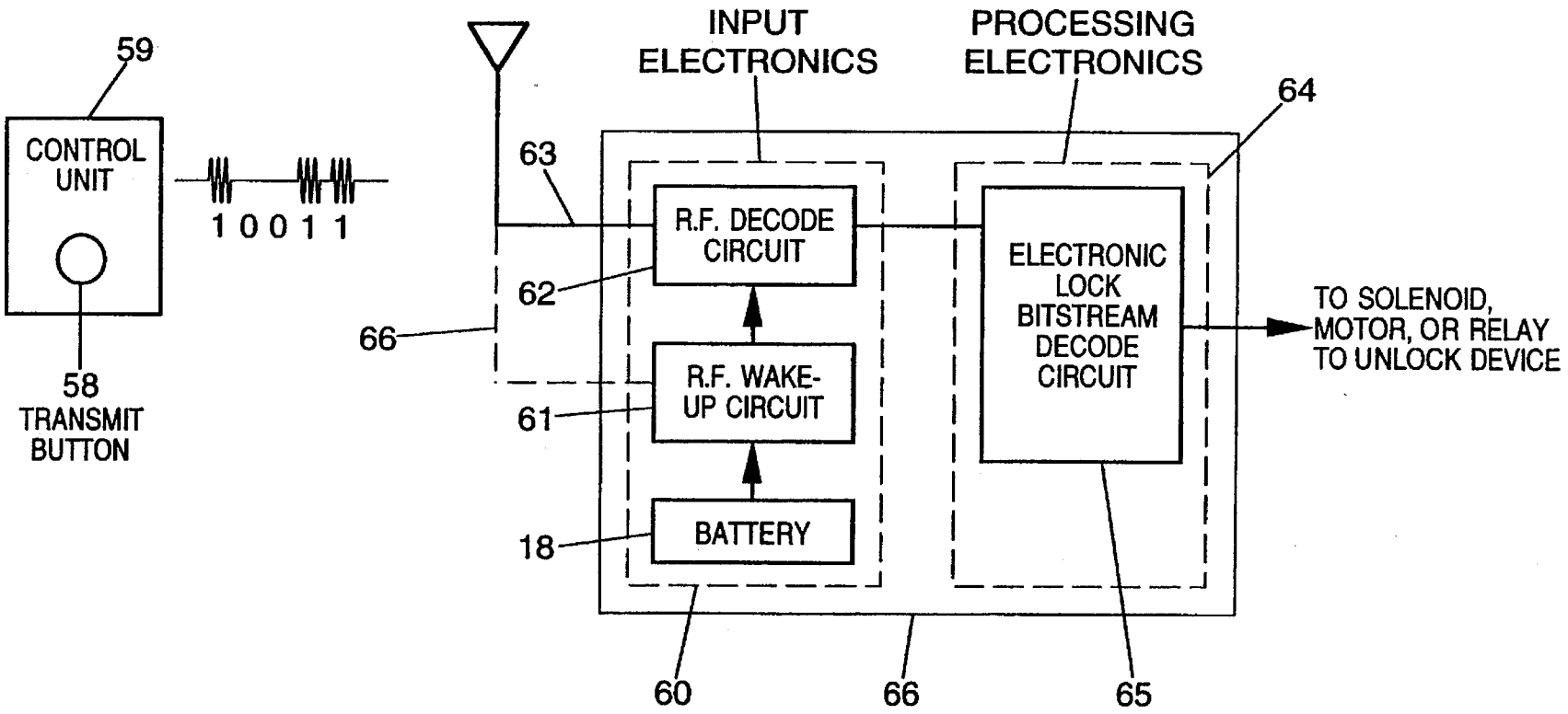
FIG. 6 is a block diagram of the device in a remote location in sleep mode.

FIG. 6 highlights another aspect of the invention, the remote operation of the electronic access code device using a battery. The device can be integrated with other electronic devices forming a system of electronic locks. At the center of the system is a central control station whereby each of the devices may be accessed.

The accessed device is designed for low power consumption so that it may operate on a battery for an extended period of time. The remote access device is normally in a sleep mode. In other words, the device is not in active operation. The remote device can "wake-up" from the low power sleep mode in a variety of ways. One method is for the circuitry in the sleep mode device to sense the incoming signal. When the signal is sent, the remote device resumes normal operation. Another method is for the circuitry in the sleep mode device periodically to resume normal operation and sense if there is an incoming signal. If the incoming signal is sent, the circuitry is able to receive the bitstream data that contains the access code. The circuitry thus remains in a low-power sleep-mode condition for the majority of the time, dissipating low power, while no signal is received. The device may then be powered by a battery.

The remote electronic access code device is divided into two parts: the input electronics 60 and the processing electronics 64. The processing electronics 64 contains a microprocessor, an access code input and output, an acoustic output, light emitting diodes (LED), a voltage regulator, and an electromechanical driver output. Thus, the remote device is similar to the microprocessor in processing the input access code, as shown in FIG. 1, except the access code may be input in several ways. In this embodiment, the data stream is input serially into the microprocessor 14 so that a variety of serial inputs may be connected to the input of the microprocessor 14. For example, the access code may be input using a traditional keypad 11 transmitting data in serial mode. Moreover, the data may be input serially using an electromagnetic signal input from the radio frequency (RF), optical frequency or infrared frequency bands. Thus, the microprocessor 14, in this configuration, may accept the input from any one of this inputs.

The input electronics 60 accepts the code sent from the central control. The method of transmitting the code may take several forms including an electromagnetic signal (such as a RF signal sent by an RF serial bitstream transmitter, or an infrared signal) or a data line (telephone line).

When an RF signal is used, the central station transmits a signal via a transmit antenna 63 (transducer that sends radiated electromagnetic fields into space). The radiated waves containing the RF signal contains the bitstream access code which is sent to the input electronics 60. The input electronics 60 contains the RF wake-up 61 and the RF decode circuitry 62. In one embodiment, the RF wake-up circuit 61 is ordinarily in a low power sleep-mode. However, for a 10 millisecond period every 1 second, the RF wake-up circuit 61 senses for an RF bitstream signal. If an RF bitstream signal exists, it remains awake and receives the entire RF bitstream signal. The RF wake-up circuit 61 then sends a wake-up enable signal to the RF decode circuit 62. The RF decode circuit 62, via the antenna 63, translates it into a series of bits and then sends the digital bitstream signal to the processing electronics 65 to determine if the digital bitstream signal contains the access code.

In another embodiment, the RF wake-up circuit 61 remains in low power sleep mode until it senses the RF signal. The RF signal, in this embodiment, contains a low carrier frequency way and a high frequency RF bitstream superimposed on the low frequency carrier wave. When the RF wake-up circuit 61 senses, via the antenna 66, that there is a signal tuned to the low frequency carrier wave, the RF wake-up circuit 61 sends a wake-up enable signal to the RF decode circuit 62. The RF decode circuit 62 then accepts the RF bitstream access code signal, and translates it into a series of bits for the microprocessor 14.

Figure 7:
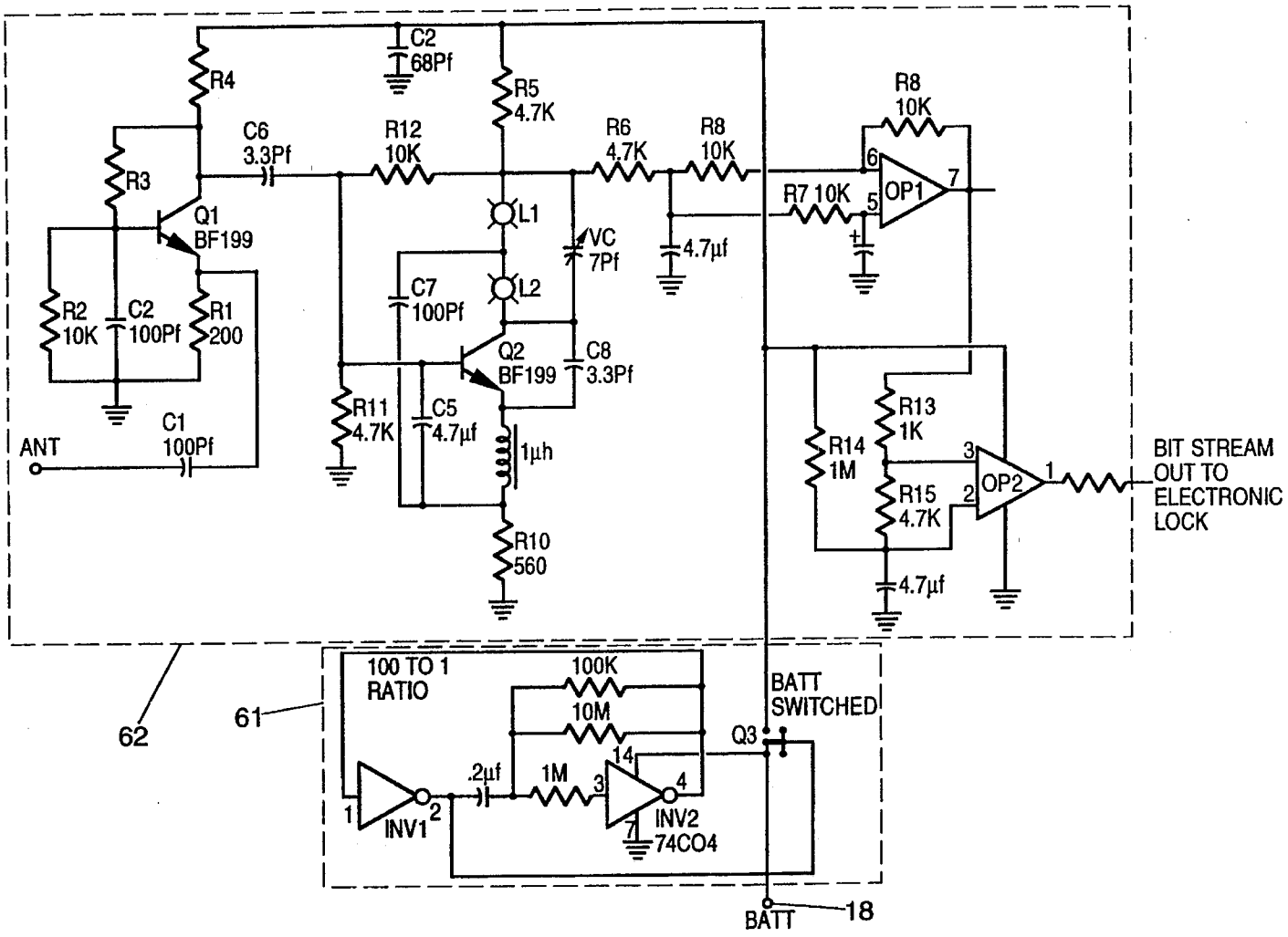
FIG. 7 is a schematic of the input electronics in a remote location in sleep mode.

FIG. 7 shows the schematic of the input electronics 60 wherein the RF wake-up circuit 61 periodically wakes up from a low power sleep mode and senses if there is an incoming RF signal. The RF wake-up circuit 61 consists of two low-power CMOS inverter gates, INV1 and INV2, a CMOS transistor Q3, resistors, and a capacitor. The two inverters INV1 and INV2 are configured in an oscillator configuration in a ratio of 1 to 100. In other words, the oscillator will switch on for 1/100 of a second. At this time, the CMOS transistor Q3 will turn on and supply the battery power to the RF decode circuitry 62. The RF decode circuitry 62 will only draw battery power for 1/100 of the time, and thus the battery will last 100 times longer than if the battery were permanently connected to the RF decode circuitry 62.

The RF decode circuitry 62 consists of two bipolar junction transistors Q1, Q2, two operational Amplifiers, OP1 and OP2, and resistors, capacitors, inductors and diodes connected to these components. The RF input signal is referred to as an on-off keying of high frequency bursts for set time frames. In the present invention, the frequency is set at 320 MHz. A burst of frequency is detected by the Q1 and Q2 transistors with their circuits tuned to the correct frequency (320 MHz in this example). The RF decode circuitry 62 then senses the data bitstream sent in the form of digital 1 data signal and digital 0 dead band of no frequency. Thus, a train of on and off frequency pulses would be received by the antenna, conditioned and amplified by Q1 and Q2 of the RF decode circuitry 62, and converted to bitstream 1 and 0 digital signals by the two operational amplifier signal conditioners OP1 and OP2.

Typically, the operator of the control unit 59 which contains the RF transmitter will enable the RF transmitter with a transmit button 58 to send an RF on-off keying pulse for approximately one second. The RF signal being transmitted is a digital bitstream conditioned to an RF on-off keying signal which takes about two milliseconds in which to transmit one complete signal. The control unit 59 then repeats the signal over and over for the duration that the RF transmitter is enabled. In order for the receiver to detect one complete bitstream from the transmitter, the RF signal only needs to be sampled for two milliseconds during which the transmitter is enabled and transmitting. If the RF transmitter is enabled for one second, the transmitted bitstream signal takes 1/500 of a second to be transmitted and is repeated 500 times over the entire one second. The receiver is enabled for 1/100 of a second every second, and will have the opportunity to sample and detect a signal that is 1/500 of a second in duration, transmitted 500 times over one second. After the 1/100 of a second, the oscillator, formed by INV1 and INV2, will switch Q3 off, and the battery power to the RF decode circuitry will be shut off. Only the oscillator circuit (INV1 and INV2) will dissipate battery power at a small rate of less than 100 micro-amps.

If less power dissipation by the RF decode circuitry 62 is required, the decode circuitry power duty cycle can be reduced by increasing the oscillator frequency to more than 100 to 1 and thus decreasing the RF decode circuitry 62 sample rate. In order to ensure the RF decode circuitry 62 will be enabled long enough to detect the entire transmitter digital bitstream, the lock CPU would wait for the beginning of the bitstream signal which is received by the RF decode circuitry 62 when the circuitry was enabled and conditioned through OP1, and then would send an output enable signal back to Q3 to override the oscillator and keep the RF decode circuitry 62 enabled with battery power until the lock CPU has received the correct amount of bitstream data from the transmitter through the decode circuitry. Thereafter, the lock CPU would disable the Q3 transistor and the RF decode circuitry and let the oscillator go back to its low rate of sampling.

The processing electronics 64 remains in sleep-mode low current operation until a valid on-off keying frequency signal is received while the RF decode circuitry is enabled and a digital bitstream signal is sent to the lock microprocessor 65. Upon transferring the bitstream signal, the microprocessor 14, within the processing electronics, compares the input code with the access code in the comparator. If correct, the solenoid, DC motor, electro-mechanical relay, or solid-state relay is activated. After this operation, the microprocessor 14 sends a disable signal to the RF wake-up circuit to assume a low power mode.

What is claimed is:

1. An electronic access control device comprising: an input device adapted to receive a value input via the input device; a storage device containing at least one access code; means for output; a processor; a comparator electrically connected to said processor for comparing the at least one access code to the value input received via the input device; said processor activating the means for output when the access code equals the value input received via the input device; said processor having at least one port which serves both as an input and an output, and said processor connected to said input device and said means for output, said processor activating the output when the input device is not receiving the value input, and said processor multiplexing the input device and the means for output by connecting said means for output with said input device by way of:

(1) a first electrical connection of the input device to the at least one port of the processor; and (2) a second electrical connection of the means for output to the at least one port of the processor.

2. An electronic access control device as defined in claim 1 wherein the means for entering a code is a keypad.

3. An electronic access control device as defined in claim 1 wherein the means for output is an acoustic device.

4. An electronic access control device as defined in claim 1 wherein the means for output is a light emitting diode.

5. An electronic access control device as defined in claim 1 wherein the means for output is an electric driver for a solenoid.

6. An electronic access control device as defined in claim 1 wherein the means for output is a DC motor.

7. An electronic access control device as defined in claim 6 where the processor contains a timer whereby the processor supplies sufficient power to open the solenoid until a preset time has elapsed in the timer, the processor then supplying a lower amount of power until another preset time has elapsed as specified by the timer.

8. An electronic access control device as defined in claim 1 wherein the means for output is a relay.

9. An electronic access control device comprising: an input device adapted to receive a value input via the input device wherein said input device is a keypad containing keypad digits in rows and columns and wherein the keypad digits are connected together across a row and the keypad digits are connected together down a column; a storage device containing at least one access code; means for output; a processor having at least one port; a comparator electrically connected to said processor for comparing the at least one access code to the value input received via the input device; said processor activating the means for output when the access code equals the value input received via the input device; said at least one port of said processor connected to said keypad digits and said means for output.

10. An electronic access control device comprising: an input device adapted to receive a value input via the input device; an electrically programmable read only memory (EPROM) containing at least one access code; at least one bidirectional data line; means for output; a processor having at least one port which serves both as an input and an output; a comparator electrically connected to said processor for comparing the at least one access code to the value input received via the input device; said bidirectional line connected to said input device, said means for output and said at least one port of the processor; said processor senses, via the at least one port, the input from said at least one bidirectional data line and uses registers to send input to said EPROM and said processor, via the at least one port, activating the means for output via the bidirectional line when the access code equals the value input received via the input device.

11. An electronic access control device as defined in claim 10 wherein said EPROM is read from and is written to in a parallel bit manner.

12. An electronic access control device as defined in claim 11 wherein said processor uses registers to send input in a parallel manner to said EPROM.

13. An electronic access control device comprising: an input device adapted to receive a value input via the input device; a storage device containing at least one access code; means for output; a processor having at least one port; a comparator electrically connected to said processor for comparing the at least one access code to the value input received via the input device; said processor activating the means for output when the access code equals the value input received via the input device; said input device and said means for output both electrically connected to said at least one port of said processor; and when the comparator indicates that input code is equal to access code, a second input received from said means for entering a code, wherein the second input is stored in the comparator to compare with subsequent input codes.

14. Method for controlling a lock using at least one microprocessor with multiple pin connections wherein the microprocessor has a port which is used both as an input and an output comprising the steps of determining the mode of operation by the at least one microprocessor, inputting data containing an access code to the port, comparing the data to a value stored in a memory device, switching the mode of operation of the at least one microprocessor to output to the port, outputting to the port a signal to open the lock.

15. The method as defined in claim 14 wherein the method of inputting data is via a keypad.

16. The method as defined in claim 15 wherein the keypad is wired to the microprocessor.

17. The method as defined in claim 14 wherein one of the outputs is used for an acoustic output.

18. The method as defined in claim 14 wherein one of the outputs is used for a solenoid.

19. The method as defined in claim 14 wherein one of the outputs is used for a DC motor.

20. The method as defined in claim 14 wherein one of the ouputs is used for a relay.

21. An electronic access control system comprising: a control station for transmitting an electromagnetic signal containing an access code; a remote station, which is powered by a battery and not physically connected to said control station, comprising:

(1) input electronics containing means for sensing an input signal wherein said input electronics has a timer, said timer activating circuitry which contains at least two states, a first state wherein the battery is connected electrically to the means for sensing and a second state wherein the battery is disconnected electrically from the means for sensing, and wherein said means for sensing contains a transducer to convert said electromagnetic signal into electrical pulses, means for decoding said electromagnetic signal connected to said means for sensing said electromagnetic signal; and (2 ) processing electronics connected to and receiving input from said means for decoding said electromagnetic signal wherein said processing electronics has a comparator for comparing the input from said means for decoding and a value stored in a memory device, and wherein said processing electronics contains a means for output and wherein said processing electronics activates said means for output when the comparator determines that the input from said means for decoding is equal to the value stored in the memory device.

22. An electronic access control system as defined in claim 21 wherein the electromagnetic signal is a radio frequency wave.

23. An electronic access control system as defined in claim 21 wherein the electromagnetic signal is an infrared frequency wave.

24. An electronic access control system as defined in claim 21 wherein the electromagnetic signal is an optical frequency wave.

25. An electronic access control system as defined in claim 21 wherein the input signal is an infrared signal.

26. An electronic access control system as defined in claim 21 wherein the input signal is a keypad input.

27. An electronic access control system as defined in claim 21 wherein the input electronics remains in low power mode until the input electronics senses an infrared frequency wave at a particular frequency.

28. An electronic access control system as defined in claim 21 wherein the input electronics remains in low power mode until the input electronics senses an infrared frequency wave at a particular frequency.

29. An electronic access control system as defined in claim 21 wherein the input electronics remains in low power mode until the input electronics senses an optical frequency wave at a particular frequency.

30. An electronic access control system as defined in claim 21 wherein the input electronics remains in low power mode until the input electronics sense a keypad input at a particular frequency.

31. Method for controlling a lock using at least one microprocessor with multiple pin connections used for inputs and outputs comprising the steps of determining the mode of operation by the at least one microprocessor, inputting data containing an access code, comparing the data to a value stored in a memory device, outputting a first current to open the lock if the data equals the value stored in the memory device, and outputting a second current which is lower than the first current to keep the lock open for reducing the power consumption of the lock.

32. An electronic access control system comprising: a control station for transmitting an electromagnetic signal containing an access code; a remote station, which is powered by a battery and not physically connected to said control station, comprising:

(1) input electronics containing means for sensing an input signal wherein said input electronics draws less than 100 microamps until said input electronics senses an electromagnetic signal at a particular frequency whereupon said input electronics draws greater than 100 microamps and wherein said means for sensing contains a transducer to convert said electromagnetic signal into electrical pulses, means for decoding said electromagnetic signal connected to said means for sensing said electromagnetic signal; and (2) processing electronics connected to and receiving input from said means for decoding said electromagnetic signal wherein said processing electronics has a comparator for comparing the input from said means for decoding and a value stored in a memory device, and wherein said processing electronics contains a means for output and wherein said processing electronics activates said means for output when the comparator determines that the input from said means for decoding is equal to the value stored in the memory device.

* * * * *

UNITED STATES PATENT AND TRADEMARK OFFICE

CERTIFICATE OF CORRECTION

PATENT NO. : 5,617,082
APPLICATION NO. : 08/339555
DATED : April 1, 1997
INVENTOR(S) : William D. Denison et al.

It is certified that error appears in the above-identified patent and that said Letters Patent is hereby corrected as shown below:

at column 11, please correct Claim 27 as follows:

27. An electronic access control system as defined in claim 21 wherein the input electronics remains in low power mode until the input electronics remains in low power mode until the input electronics senses an infrared frequency wave at a particular frequency.

SHOULD READ
-- 27. An electronic access control system as defined in claim 21 wherein the input electronics remains in low power mode until the input electronics remains in low power mode until the input electronics senses a radio frequency wave at a particular frequency. --

Signed and Sealed this

Twenty-fifth Day of March, 2008

JON W. DUDAS
*Director of the United States Patent and Trademark Office*